US007070399B2

(12) United States Patent
Konishi et al.

(10) Patent No.: US 7,070,399 B2
(45) Date of Patent: Jul. 4, 2006

(54) VARIABLE DISPLACEMENT PUMP WITH A SUCTION AREA GROOVE FOR PUSHING OUT ROTOR VANES

(75) Inventors: Hideo Konishi, Saitama (JP); Kazuyoshi Uchino, Saitama (JP); Haruo Okamoto, Saitama (JP)

(73) Assignee: Unisia JKC Steering Co., Ltd., Kanagawa (JP)

( * ) Notice: Subject to any disclaimer, the term of this patent is extended or adjusted under 35 U.S.C. 154(b) by 0 days.

(21) Appl. No.: 10/253,423

(22) Filed: Sep. 25, 2002

(65) Prior Publication Data

US 2003/0059312 A1 Mar. 27, 2003

(30) Foreign Application Priority Data

Sep. 27, 2001 (JP) ..... P. 2001-297103
Mar. 12, 2002 (JP) ..... P. 2002-067248

(51) Int. Cl.
*F04B 17/03* (2006.01)

(52) U.S. Cl. ..... 417/410.3; 417/213; 417/310; 418/268; 418/82

(58) Field of Classification Search ..... 417/410.3, 417/213, 310; 418/268, 82
See application file for complete search history.

(56) References Cited

U.S. PATENT DOCUMENTS 2,786,422 A * 3/1957 Rosaen et al. ..... 418/82
3,223,044 A 12/1965 Adams et al.
3,865,520 A * 2/1975 Kramer et al. ..... 418/82
4,653,991 A * 3/1987 Takao et al. ..... 418/82
4,722,652 A * 2/1988 Jingin et al. ..... 417/204
4,867,658 A * 9/1989 Sugita et al. ..... 418/76
4,936,761 A * 6/1990 Hasegaki et al. ..... 418/84
5,141,418 A * 8/1992 Ohtaki et al. ..... 418/26
5,154,593 A * 10/1992 Konishi et al. ..... 418/77
5,466,135 A * 11/1995 Draskovits et al. ..... 418/268
5,490,770 A * 2/1996 Oogushi ..... 418/27
6,015,278 A * 1/2000 Key et al. ..... 418/82
6,234,776 B1 * 5/2001 Hayashi et al. ..... 418/133
6,375,441 B1 * 4/2002 Ichizuki et al. ..... 418/30
6,422,845 B1 * 7/2002 Wong et al. ..... 418/133
6,530,752 B1 * 3/2003 Oba et al. ..... 417/220
6,634,865 B1 * 10/2003 Dalton ..... 417/220

FOREIGN PATENT DOCUMENTS

| | | |
|---|---|---|
| GB | 627924 | 8/1949 |
| JP | 6-200883 | 7/1994 |
| JP | 6-241176 | 8/1994 |
| JP | 2000-170667 A | 6/2000 |
| JP | 2001-59482 A | 3/2001 |
| WO | WO 00/39465 A1 | 7/2000 |

* cited by examiner

*Primary Examiner*—Timothy S. Thorpe
*Assistant Examiner*—Emmanuel Sayoc
(74) *Attorney, Agent, or Firm*—Sughrue Mion, PLLC

(57) ABSTRACT

A variable displacement pump has a cam ring, a rotor, a plurality of vanes, a pressure plate and a rear body. The cam ring is accommodated within a pump body. The rotor rotates within the cam ring. The plurality of vanes are inserted retractably into slits formed at regular intervals circumferentially in the rotor. The pressure plate and the rear body carry the cam ring and the rotor. A circular groove communicating to a back pressure inlet bore on a bottom portion of the slits is formed in a suction area on a face of the rear body on a side of the rotor. The groove is communicated via a communication passage to a passage between a power steering gear and a tank T to introduce a working oil after used in the power steering gear.

8 Claims, 14 Drawing Sheets

VARIABLE DISPLACEMENT PUMP WITH A SUCTION AREA GROOVE FOR PUSHING OUT ROTOR VANES

The present disclosure relates to the subject matter contained in Japanese Patent Application No.2001-297103 filed on Sep. 27, 2001 and Japanese Patent Application No.2002-067248 filed on Mar. 12, 2002, which are incorporated herein by reference in its entirety.

BACKGROUND OF THE INVENTION

1. Field of the Invention

The present invention relates to a variable displacement pump useful as a pressure supply source of a pressure fluid utilization apparatus such as a power steering gear for the vehicle.

2. Description of the Related Art

A variable displacement pump of vane type typically includes a cam ring having a cam face on the inner circumference thereof, a rotor rotating within the cam ring, a plurality of vanes inserted retractably into slits formed at regular intervals circumferentially on the outer circumference of the rotor, and two plates (or plate-like pump bodies) carrying the cam ring and the rotor from both sides. Each vane slides with the cam ring along with the rotation of the rotor to increase or decrease the volume of a pump chamber formed between two adjacent vanes, so that oil is sucked or discharged.

In this vane pump, a back pressure inlet bore with an inner circumferential end portion of each slit expanded is provided so that each vane is pushed out of the slit of the rotor and surely contacted with an inner circumferential cam face of the cam ring, and a circular groove opposed to the back pressure inlet bore is formed on a face of the plate contact with the rotor. An oil discharged from the pump is introduced via this groove into the back pressure inlet bore.

The vane pump according to the related art applies a pump discharge pressure to a base end portion (an end portion on the inner side) of the vane so that the vane is pushed out and surely contacted with the cam. Therefore, oil must be discharged excessively by the amount needed to push out the vane, and if the discharge pressure is increased, a vane located in a suction area at low pressure is always pressed strongly against the cam, increasing a friction loss, so that the drive power of the pump is increased due to the increased discharge amount and friction loss, leading to a problem of worse fuel consumption. Also, the cam contact portion is worn due to friction, leading to a problem of shorter life.

In the constitution according to the related art, a discharge pressure is introduced into the bottom portion of slit so that the vane is pushed out and pressed against the cam, whereby the discharge amount is increased, and the suction area vane is pressed more strongly than needed, resulting in the above problems. Thus, a variable displacement pump has been proposed in which the circular grooves are formed in the discharge area and the suction area, respectively, to introduce a pump discharge pressure into the discharge area groove, and introduce a pump suction pressure into the suction area groove (JP-A-6-200883 and JP-A-6-241176).

In the constitution of the variable displacement pump as disclosed in the above publications, a pressure almost equal to the pressure within the pump chamber facing a top end portion of the vane is introduced into the base end portion of vane, resulting in a problem that a pressing force of the vane against the cam ring is insufficient.

SUMMARY OF THE INVENTION

The present invention has been achieved to solve the above problems, and it is an object of the invention to provide a variable displacement pump capable of effectively utilizing a pump discharge flow without detracting a pressing force of the vane against the cam ring, and capable of reducing a drive power with a low slide resistance.

In the vane pump, a higher pressure is applied on the base end portion of vane than on the top end portion, so that the top end face of vane can be always pressed against the inner circumferential face of the cam ring. However, at the start time when the discharge of oil is not started, a pressure to be applied on the base end portion of vane can not be obtained. At this point of time, the vane is simply jutted out due to a centrifugal force of the rotating rotor, in which the top end of vane is out of contact with the inner face of the cam ring, because the vane is insufficiently jutted out, resulting in a problem that the variable displacement pump can not start discharging in any way.

Another invention has been achieved to solve this problem, and is aimed at discharging the oil rapidly by pressing the vane against the cam ring as rapidly as possible at the start time of the variable displacement pump.

According to a first aspect of the invention, there is provided a variable displacement pump having a cam ring accommodated within a pump body, a rotor rotating within the cam ring and formed slits at regular intervals circumferentially and closer to outer circumference thereof, a plurality of vanes inserted retractably into the slits, and two plates carrying the cam ring and the rotor from both sides. A circular groove communicating to bottom portions of the slits is formed on a face of at least one of the plates on a side of the rotor. A pressure fluid is introduced into the circular groove to push out the vanes. The circular groove is partitioned into a suction area groove and a discharge area groove. A pump suction port is formed on at least one of plates. Pressure introduced into the suction area groove is slightly higher than pressure at the pump suction port.

In the constitution of this variable displacement pump, because a higher pressure than the suction pressure acting on the top end portion of the vane is applied to the base end portion of the vane, the vane can be surely pressed against the cam ring without shortage of a pressing force for pressing the vane against the cam ring. Unlike the case where the pump discharge pressure is introduced, the pump discharge flow can be fully utilized for the fluid pressure utilization apparatus to reduce the drive power. Furthermore, the drive power for the pump can be reduced with lower friction loss between the vane and the cam ring because the vane is not pressed against the cam ring with excessive force.

According to a second aspect of the invention, there is provided a variable displacement pump having a cam ring accommodated within a pump body, a rotor rotating within the cam ring and formed slits at regular intervals circumferentially and closer to outer circumference thereof, a plurality of vanes inserted retractably into the slits, and two plates carrying the cam ring and the rotor from both sides. A circular groove communicating to bottom portions of the slits is formed on each of faces of the plates on a side of the rotor. A pressure fluid is introduced into the circular groove to push out the vanes. The circular groove is partitioned into a suction area groove and a discharge area groove. The discharge area groove on one plates has a start point close to an end portion of a suction area and a terminal point located in the middle of the discharge are. The suction area groove on the other plates has a start point close to the end portion of the suction area and an end point close to a start portion of the suction area. A restrictor passage connects the suction area groove to a discharge chamber formed on the one plates.

In the variable displacement pump of this constitution, if the vane slightly jutted out due to a centrifugal force at the start time is contacted with the inner face of the cam ring near the end portion in the discharge area and pushed into the inside of the slit, the oil on the bottom portion of the slit is pushed out and introduced into the bottom portion of the subsequent vane that is not yet contacted with the cam ring, so that the vane is pushed out and pressed against the inner circumferential face of the cam ring, whereby the discharge of oil can be started rapidly at the start time.

According to a third aspect of the invention, a pump suction port is formed on at least one of plates. Pressure introduced into the suction area groove is slightly higher than pressure at the pump suction port.

In the variable displacement pump of this constitution, at the start time, the discharge of oil can be started rapidly by pressing the vane against the cam ring as rapidly as possible, and the vane can be pressed against the cam ring with an adequate force by introducing an optimal pressure into the base end side of the vane, while driving.

According to a fourth aspect of the invention, a pump chamber is formed between two adjacent vanes. A communication passage connecting a passage between a fluid pressure utilization apparatus supplied with a pressure fluid discharged from the pump chamber and a tank, to the suction area groove.

According to a fifth aspect of the invention, a pump chamber is formed between two adjacent vanes. A restrictor is provided in the middle of a suction passage from a tank to the pump chamber. A connection passage for introducing an upstream pressure of the restrictor into the suction area groove is formed.

According to a sixth aspect of the invention, an inlet passage for introducing a fluid leaked from a discharge area to periphery of a shaft driving the rotor into the suction area groove is formed.

According to a seventh aspect of the invention, the variable displacement pump further has a relief valve built in the variable displacement pump. A relief passage for supplying a fluid relieved from the relief valve to the suction area groove is formed.

According to an eighth aspect of the invention, the variable displacement pump further has a relief valve built in the variable displacement pump. A relief passage for supplying a fluid relieved from the relief valve to the suction area groove is formed. An inlet passage for introducing a fluid leaked from a discharge area to periphery of a shaft driving the rotor into the suction area groove is formed.

DETAILED DESCRIPTION OF THE PREFERRED EMBODIMENTS

Figure 1:
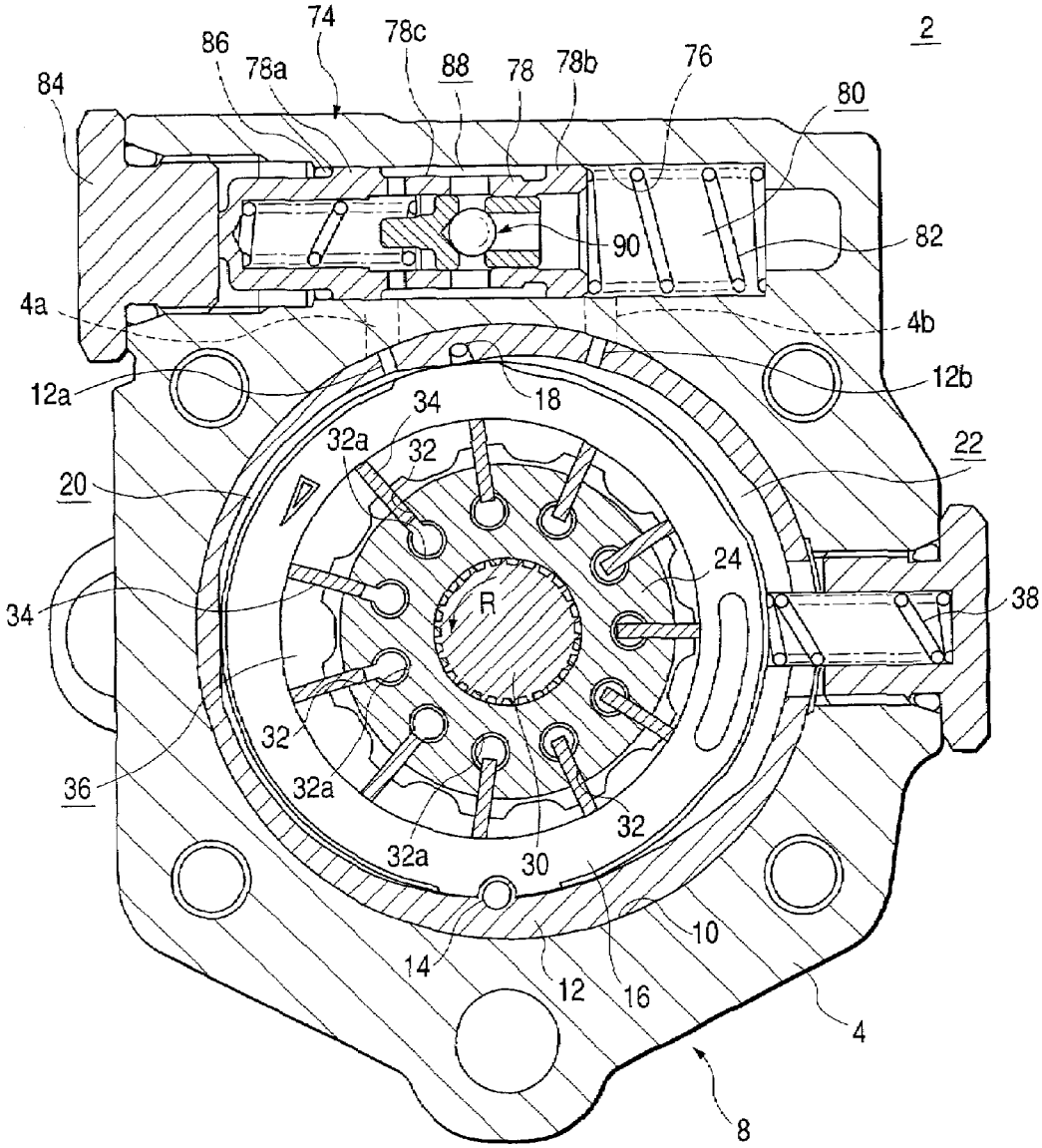
FIG. 1 is a cross-sectional view of a variable displacement pump according to one embodiment of the present invention, taken along the line I—I of FIG. 2.
Figure 2:
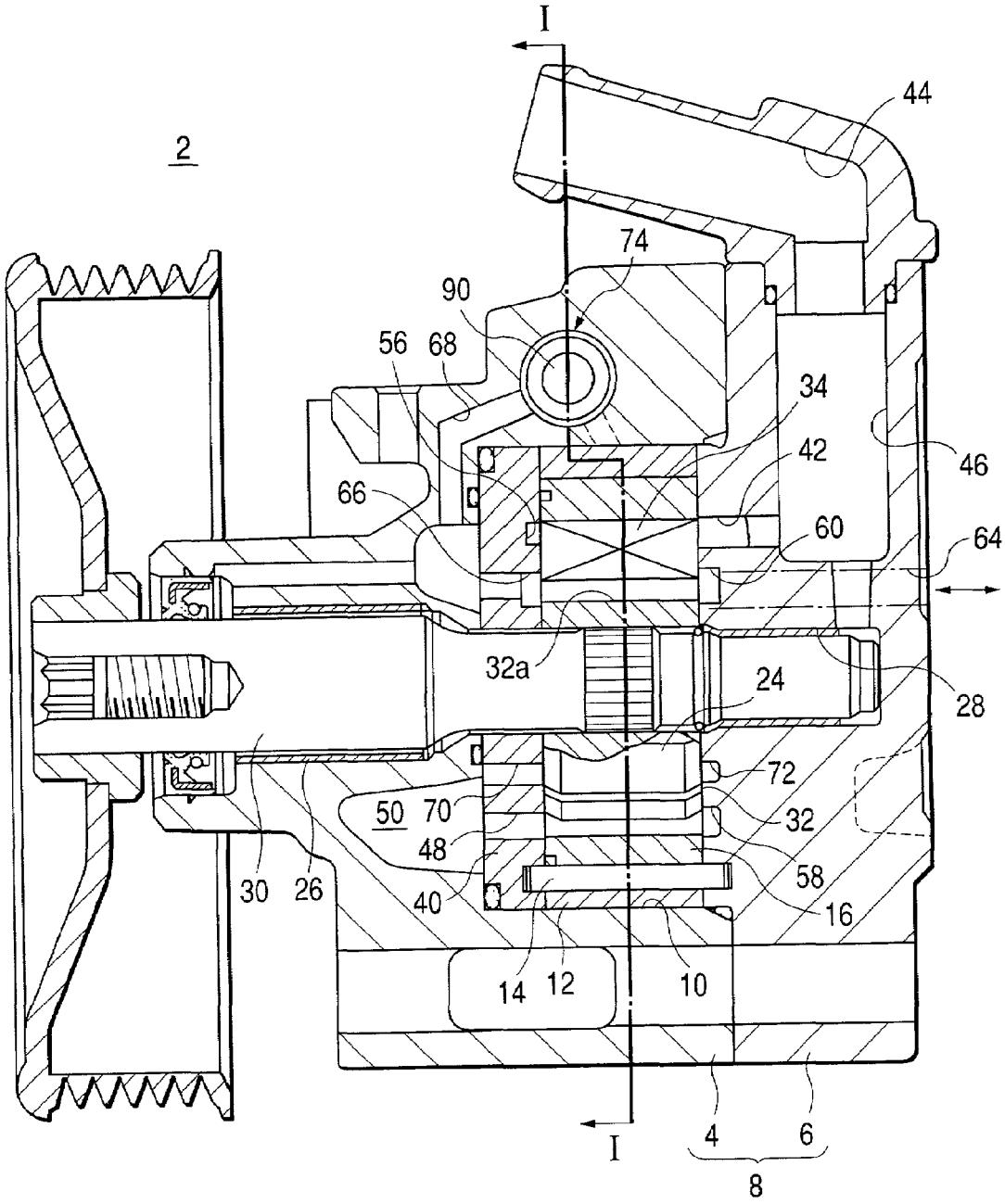
FIG. 2 is a cross-sectional view of the variable displacement pump, taken along the axial line of a drive shaft.
Figure 3:
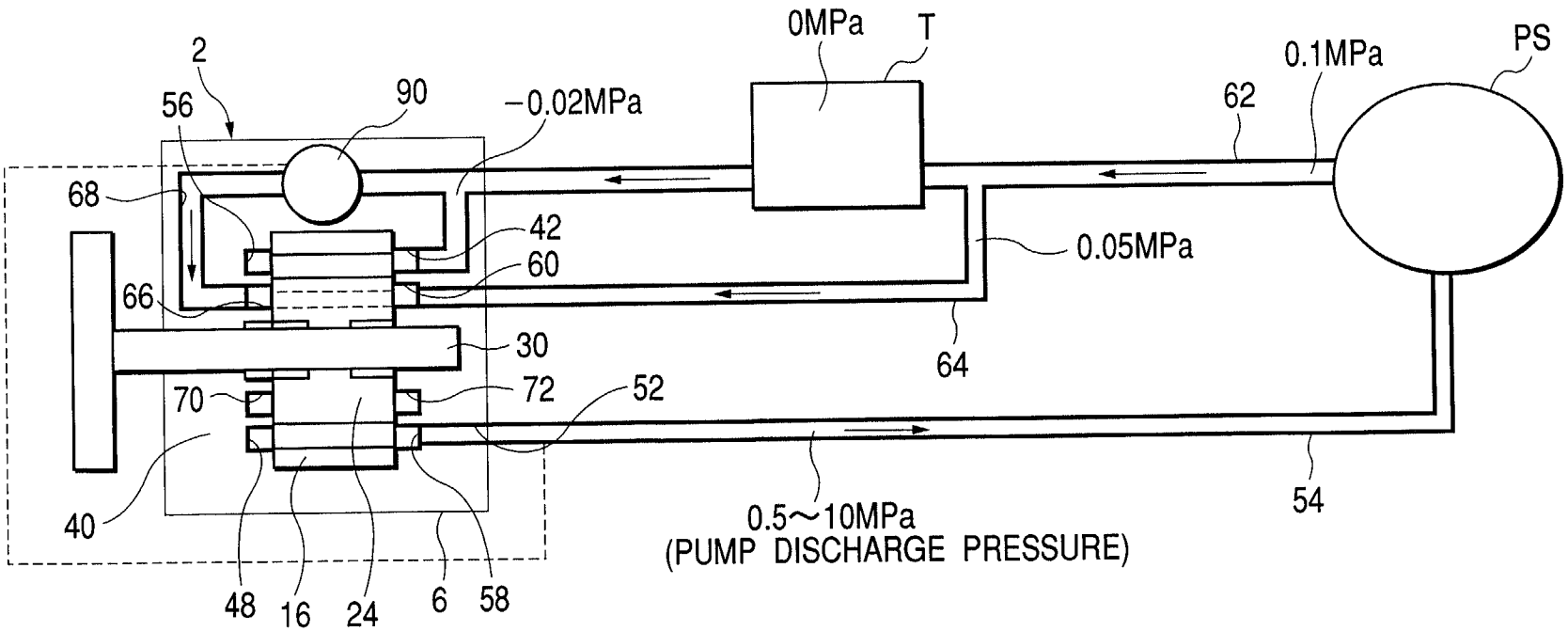
FIG. 3 is a simplified diagram showing a hydraulic circuit containing the variable displacement pump.

The preferred embodiments of the present invention will be described below with reference to the accompanying drawings. In the drawings, pressure of fluid is exemplified for explanation. It is noted that the present invention is not limited to the exemplified pressure value. FIGS. 1 and 2 show the constitution of a variable displacement pump (as denoted by numeral 2 as a whole) according to one embodiment of the invention. FIG. 1 is a cross-sectional view of the variable displacement pump, taken along the line I—I of FIG. 2. FIG. 2 is a cross-sectional view of the variable displacement pump, taken along the axial line of a drive shaft. FIG. 3 is a simplified diagram showing the entire configuration of a hydraulic circuit containing the variable displacement pump.

This variable displacement pump 2 has an accommodation space 10 for accommodating the pump components as a pump cartridge that is formed within a pump body 8 having a front body 4 and a rear body 6 joined together, an adapter ring 12 being fitted into the inner face of this accommodation space 10. Within an almost elliptic space of this adapter ring 12, a cam ring 16 is disposed swingably via a swing fulcrum pin 14. A seal member 18 is provided at a position of the cam ring 16 in almost axial symmetry to the swing fulcrum pin 14. A first fluid pressure chamber 20 and a second fluid pressure chamber 22 are formed as compartments on both sides of the cam ring 16 in the swing direction by the swing fulcrum pin 14 and the seal member 18.

Moreover, a rotor 24 is disposed on the inner circumferential side of the cam ring 16. The rotor 24 is connected to a drive shaft 30 penetrating through the pump body 8 and supported rotatably by bearings 26 and 28. When the drive shaft 30 is driven by an engine, not shown, the rotor 24 is rotated in a direction of an arrow R in FIG. 1.

On the outer circumferential side of the rotor 24, the radial slits 32 are formed at regular intervals in circumferential direction, each slit 32 having a vane 34 inserted, and held slidably. A back pressure inlet bore **32*a* is formed by expanding an inner circumferential side end portion of each slit 32, and a fluid pressure (hydraulic pressure) is introduced into this back pressure inlet bore 32*a* to apply the pressure to the base end portion of the vane 34 to push out the vane 34 and press the cam ring 16** onto the inner circumferential cam face.

The cam ring 16 is disposed eccentrically with respect to the rotor 24 connected to the drive shaft 30, and a pump chamber 36 is formed within a space formed between the cam ring 16 and the rotor 24 by two adjacent vanes 34. This cam ring 16 is swung at the fulcrum of the swing fulcrum pin 16 to increase or decrease the volume of this pump chamber 36.

A compression coil spring 38 is disposed on a second fluid pressure chamber 22 of the pump body 8 to always urge the cam ring 16 toward a first fluid pressure chamber 20 side, that is, in a direction of making the volume of the pump chamber 36 be maximum.

The adapter ring 12, the cam ring 16 and the rotor 24 are accommodated within the accommodation space 10 inside the pump body 8, as conventionally well known, and carried from both sides by the rear body 6 serving as a side plate and a pressure plate 40.

A suction opening 42 is formed on a face of the rear body 6 on the side of the rotor 6 in a suction area A (see FIG. 4) where the volume of the pump chamber 36 formed between two adjacent vanes 34 is gradually expanded along with the rotation of the rotor 24. The working fluid (working oil) sucked from a tank T (see FIG. 3) through a suction port 44 and a suction passage 46 is supplied through the suction opening 42 to the pump chamber 36.

Also, a discharge opening 48 is formed on a side face of the pressure plate 40 in a discharge area B (see the underside of FIG. 4) where the volume of the pump chamber 36 is gradually reduced along with the rotation of the rotor 24. A pressure fluid discharged from the pump chamber 36 is introduced through the discharge opening 48 into a discharge pressure chamber 50 formed on a bottom portion of the front body 4. This discharge pressure chamber 50 is led from a discharge port 52 (see FIG. 3) formed in the pump body 8 via a pump discharge pipe 54 to a power cylinder of the power steering gear PS.

At a position of the pressure plate 40 that is opposed to the suction opening 42 formed in the rear body 6, a groove portion 56 of almost the same shape is formed. Furthermore, at a position of the rear body 6 that is opposed to the discharge opening 48 formed in the pressure plate 40, a groove portion 58 (see FIGS. 2 and 4) of almost the same shape is formed. By forming the groove portion 56 opposed to the suction opening 42 and the groove portion 58 opposed to the discharge opening 48, the pressure balance across the pump chamber is kept.

In the suction area A on the face of the rear body 6 on the side of the rotor 24, a circular groove 60 is formed at a position substantially facing a back pressure inlet bore 32*a* on the bottom portion of each slit 32 formed in the rotor 24. The circular groove 60 in the suction area A is connected to a fluid passage 62 between a valve exit of the power steering gear PS and the tank T via a communicating passage 64 and a return pressure supply bore 65 (see FIGS. 4 and 5) formed in the rear body 6, as shown in FIG. 3. Also, a circular groove 66 is formed at a position corresponding to the circular groove 60 in the suction area A on the face of the pressure plate 40 on the side of the rotor 24. A relief passage 68 from a relief valve, as will be described later is connected to this circular groove 66.

Also, in the discharge area B on the face of the pressure plate 40 on the side of the rotor 24, a circular groove 70 is formed at a position substantially facing the back pressure inlet bore 32*a* on the bottom portion of each slit 32 formed in the rotor 24. The circular groove 70 in the discharge area B is connected to the discharge pressure chamber 50 to introduce a discharge pressure. On the other hand, a circular groove 72 is formed at a position corresponding to the circular groove 70 in the discharge area B on the face of the rear body 6 on the side of the rotor 24.

Figure 4:
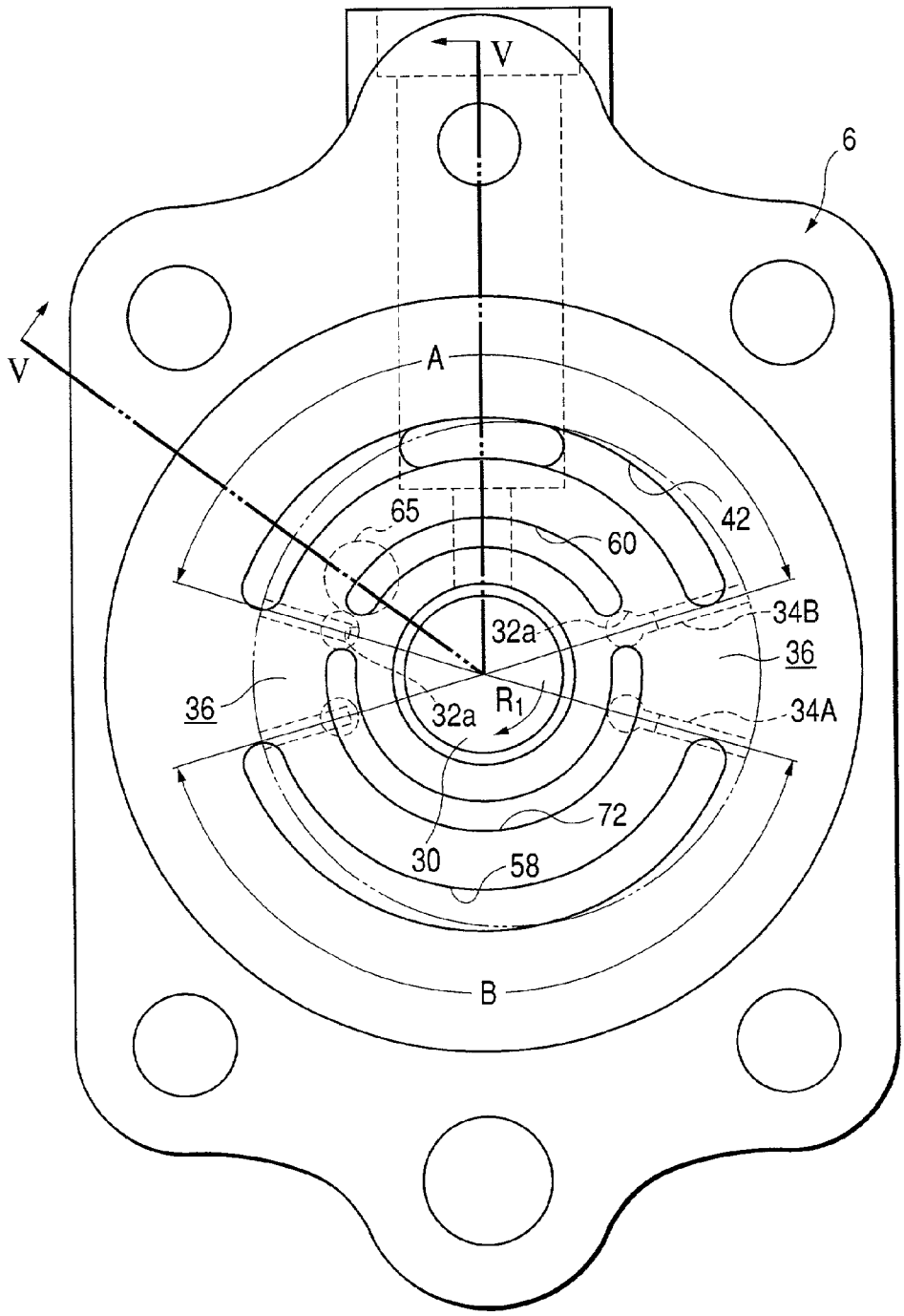
FIG. 4 is a front view of a rear body of the variable displacement pump.
Figure 5:
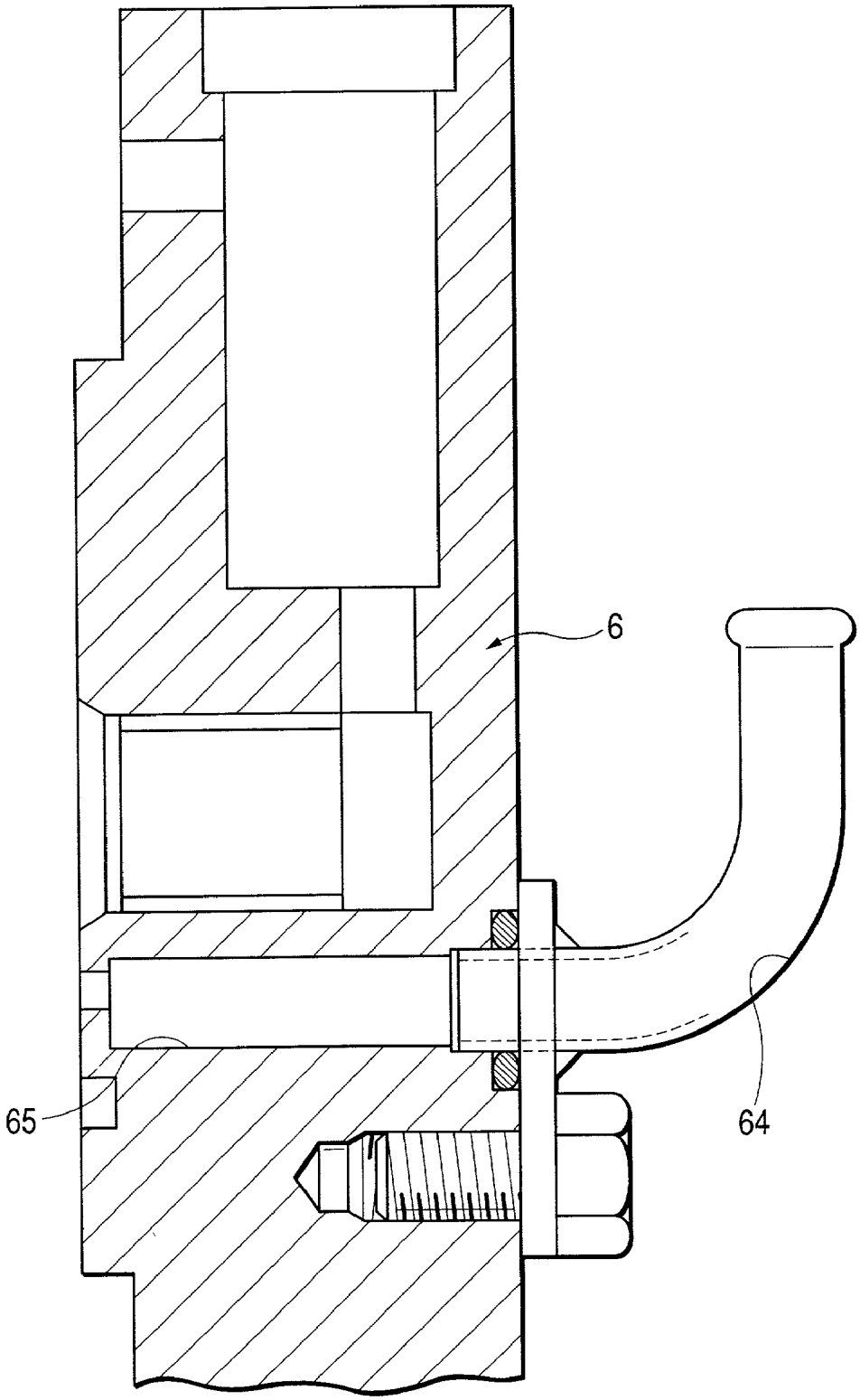
FIG. 5 is a longitudinal cross-sectional view of the rear body, taken along the line V—V of FIG. 4.

Referring to FIG. 4, how the circular groove 60 in the suction area A and the circular groove 70 in the discharge area B are disposed in the rotational direction will be described below. Incidentally, the circular groove 70 in the discharge area B is formed on the side of the pressure plate 40. However, the circular groove 70 has the same shape as the circular groove 72 of the rear body 6. Therefore, description will be given with reference to the circular groove 72 of the rear body 6. The circular groove 72 (70) in the discharge area B is extended at both ends toward the circular groove 60 in the suction area A. At the time when the pump chamber 36 formed between two adjacent vanes 34 (see the vanes as denoted by 34A and 34B in the figure) transfers from suction side to discharge side, namely, when a rear vane 34B gets out of the suction opening 42, and a fore vane 34A transfers to the discharge opening 58 (48), the back pressure inlet bore 32*a* of the slit 32 having the rear vane 34B inserted gets out of the circular groove 60 in the suction area A, and already communicates to the circular groove 72 (70) in the discharge area B.

A control valve 74 is provided within the pump body 8 and faces in a direction orthogonal to the drive shaft 30, as shown in FIG. 1. This control valve 74 has a spool 78 fitted slidably within a valve bore 76 formed in the front body 4. This spool 78 is always urged to the left (toward the first fluid pressure chamber 20) in FIG. 1 by a spring 82 disposed within a chamber 80 (hereinafter referred to as a spring chamber) at one end (i.e., at a side end portion of the second fluid pressure chamber 22 on the right side in FIG. 1). When inactivated, the spool 78 is abutted against the front face of a plug 84 screwed into an opening portion of the valve bore 76 to close the bore 76 and therefore, the spool 78 stops.

A metering orifice (not shown) is provided halfway on the discharge passage leading from the pump chamber 36 to the fluid pressure utilization apparatus (power steering gear PS in this embodiment). An upstream pressure of this metering orifice is introduced into a left chamber 86 (hereinafter referred to as a high pressure chamber), while a downstream pressure of the metering orifice is introduced into the spring chamber 80. Whereby, if a pressure difference between both the chambers 86 and 80 exceeds a predetermined value, the spool 78 is moved to the right in the figure against the spring 82.

The first fluid pressure chamber 20 formed on the left side of the cam ring 16 is in communication via the connection passages 4*a* and 12*a* formed in the front body 4 and the adapter ring 12 to the high pressure chamber 86 of the valve bore 76, while the second fluid pressure chamber 22 formed on the right side of the cam ring 16 is in communication via the connection passages 4*b* and 12*b* formed in the front body 4 and the adapter ring 12 to the spring chamber 80 of the valve bore 76.

A first land portion 78*a* for comparting the high pressure chamber 86 and a second land portion 78*b* for comparting the spring chamber 80 are formed around the outer circumferential face of the spool 78. An annular groove portion 78*c* is provided intermediately between these land portions 78*a* and 78*b*. This intermediate annular groove portion 78*c* is connected to the tank T. A space between this annular groove portion 78*c* and the inner circumferential face of the valve bore 76 makes up a pump suction chamber 88.

The first fluid pressure chamber 20 provided on the left side of the cam ring 16 is connected via the connection passages 4*a* and 12*a* to the pump suction chamber 88, when the spool 78 is in inactive position as shown in FIG. 1. If the spool 78 is activated due to a pressure difference across the metering orifice, the first fluid pressure chamber 20 is gradually shut off from the pump suction chamber 88 and communicated to the high pressure chamber 86. Accordingly, the first fluid pressure chamber 20 is selectively supplied with a pressure of the pump suction side or a pressure in the upstream of the metering orifice provided within the pump discharge passage.

The second fluid pressure chamber 22 provided on the right side of the cam ring 16 is connected via the connection passages 4*b* and 12*b* to the spring chamber 80, when the spool 78 is in inactive position. If the spool 78 is activated, the second fluid pressure chamber 22 is gradually shut off from the spring chamber 80 and connected to the pump suction chamber 88. Accordingly, the second fluid pressure chamber 22 is selectively supplied with a pressure in the downstream of the metering orifice or a pressure of the pump suction side.

A relief valve 90 is provided inside the spool 78, and opened to cause the fluid pressure to escape, if the pressure within the spring chamber 80 (the downstream pressure of the metering orifice, or the working pressure of the power steering gear PS) is increased to exceed a predetermined value. Furthermore, in this embodiment, the relieved fluid is passed via the relief passage 68 (see FIGS. 2 and 3) into the circular groove 66 formed in the pressure plate 40 and facing the circular groove 60 formed in the suction area A of the rear body 6.

In the variable displacement pump of the above constitution, while the vane 34 is moving in the suction area A, a pump suction pressure is applied to the top end portion of the vane 34, and a working oil after use in the power steering gear PS is introduced into the back pressure inlet bore 32*a* on the bottom portion of the slit 32 via the communicating passage 64 connected to the pipe 62 from the power steering gear PS back to the tank T, a return pressure supply bore 65, and the circular groove 60 in the suction area A. The oil pressure is applied on the base end portion of the vane 34.

The working oil flowing from the power steering gear PS back to the tank T and acting on the base end portion of the vane 34, has a slightly higher pressure (has 0.05 MPa in pressure, (FIG. 3)) than the pressure (−0.02 MPa) on the pump suction side due to a line resistance and a filter resistance within the tank T. Therefore, the vane 34 is pushed out of the slit 32 and surely pressed against the inner face of the cam ring 16. Also, this pressure is only slightly higher than the pump suction pressure (by 0.07 MPa=0.05 MPa−(−0.02 MPa) (FIG. 3)), but significantly lower than the pump discharge pressure (0.5 MPa to 10 MPa) as conventionally obtained. Therefore, the friction loss between the inner circumferential cam face of the cam ring 16 and the vane 34 is decreased and the drive power of the pump 2 can be reduced. Since the working oil after use in the power steering gear PS is used, the discharge flow from the pump 2 can be almost totally supplied to the power steering gear PS to get rid of a waste and reduce the drive power of the pump. It is noted that in case of no-load operation, the pump discharge pressure becomes the minimum pressure, for example, 0.5 MPa. In this embodiment, the maximum pump discharge pressure is set to 10 MPa. Of course, the maximum pump discharge pressure may be designed desirably.

At the time when the pump chamber 36 formed between two adjacent vanes 34 is moved from the suction area A to the discharge area B, namely, when the rear vane 34B (see FIG. 4) of two vanes 34 is passed through the suction opening 42 and the fore vane 34A is moved to the discharge opening 48 so that the pump chamber 36 formed between these two vanes 34A and 34B is transferred to the discharge area B, the back pressure inlet bore 32*a* formed on the bottom portion of the slit 32 into which the fore vane 34A is fitted is already in communication to the circular groove 70 in the discharge area B. Accordingly, the read vane 34B is not pushed in due to a discharge pressure of the pump chamber 36.

On the other hand, while the vane 34 is moving in the discharge area B, a pump discharge pressure is introduced through the circular groove 70 in the discharge area B into the back pressure inlet bore 32*a* on the bottom portion of the slit 32 in the same manner as conventionally made, so that the vane 34 is pushed out and pressed against the cam ring 16.

When the power steering gear PS is normally activated, a working oil after use in the power steering gear PS is introduced via the communicating passage 64 into the circular groove 60 in the suction area A, and acts on the base end portion of the vane 34 to press the vane 34 against the cam ring 16. When the relief valve 90 is activated, a pump discharge oil is passed directly from the relief valve 90 to the pump suction chamber to reduce the flow of oil supplied to the power steering gear PS, and produce a less pressure due to the resistance through the filter within the tank T or the pipe, so that the vane 34 can not be pushed out owing to this pressure. The pressing-out force becomes only centrifugal force due to the rotation of the rotor and thus weakens.

However, in this embodiment, since the relief passage 68 is formed to supply the oil relieved from the relief valve 90 to the circular groove 66 (circular groove formed in the pressure plate 40) in the suction area A, the vane 34 can be surely pushed out due to the oil relieved from the relief valve 90, and pressed against the cam ring 16.

The oil relieved from the relief valve 90 and used to push out the vane 34 returns through the circular groove 60 of the rear body 6 formed facing the circular groove 66 of the pressure plate 40 back to the tank T. In this way, in this embodiment, even when the relief valve 90 is activated, it is possible to surely supply a pressure fluid (pressure oil) to the base end portion of the vane 34 and push out the vane 34.

Figure 6:
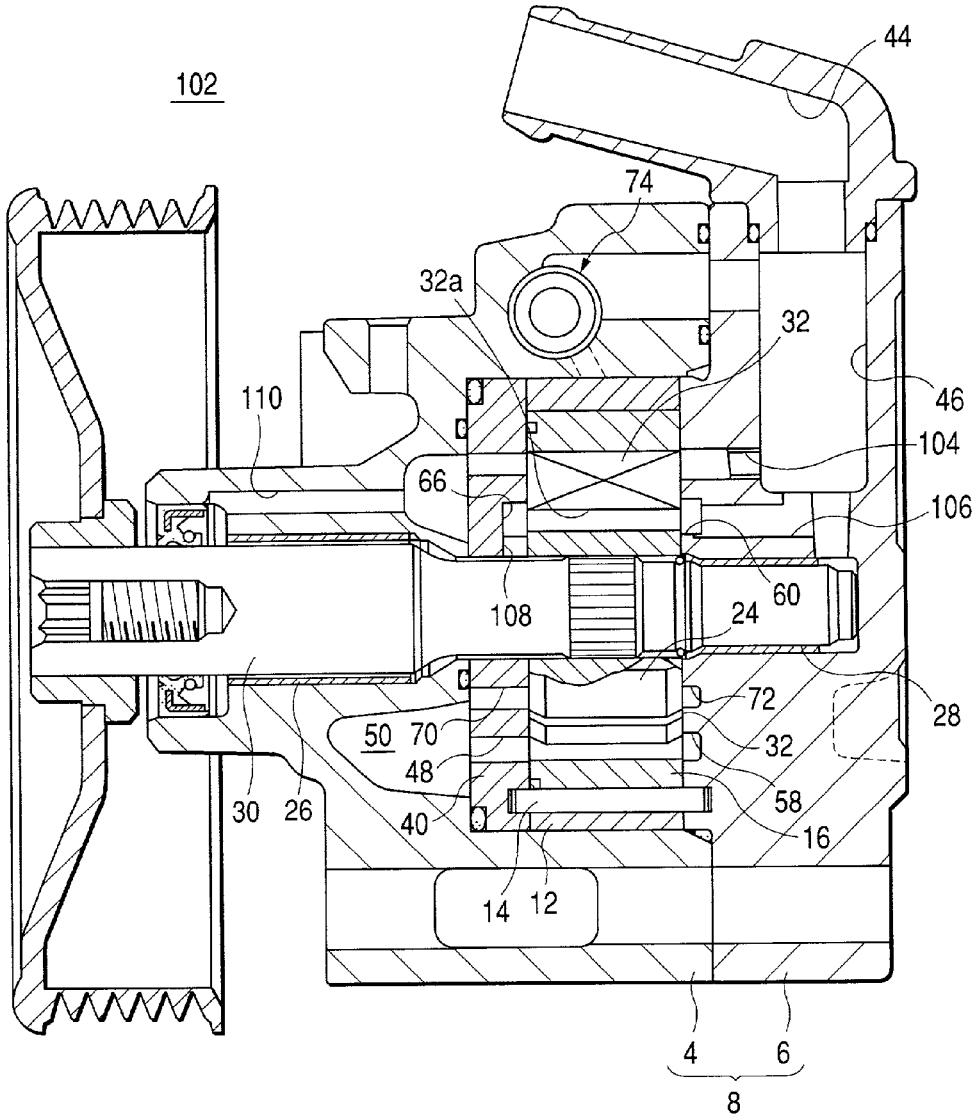
FIG. 6 is a cross-sectional view of a variable displacement pump according to a second embodiment of the invention, taken along the axial line of a drive shaft.
Figure 8:
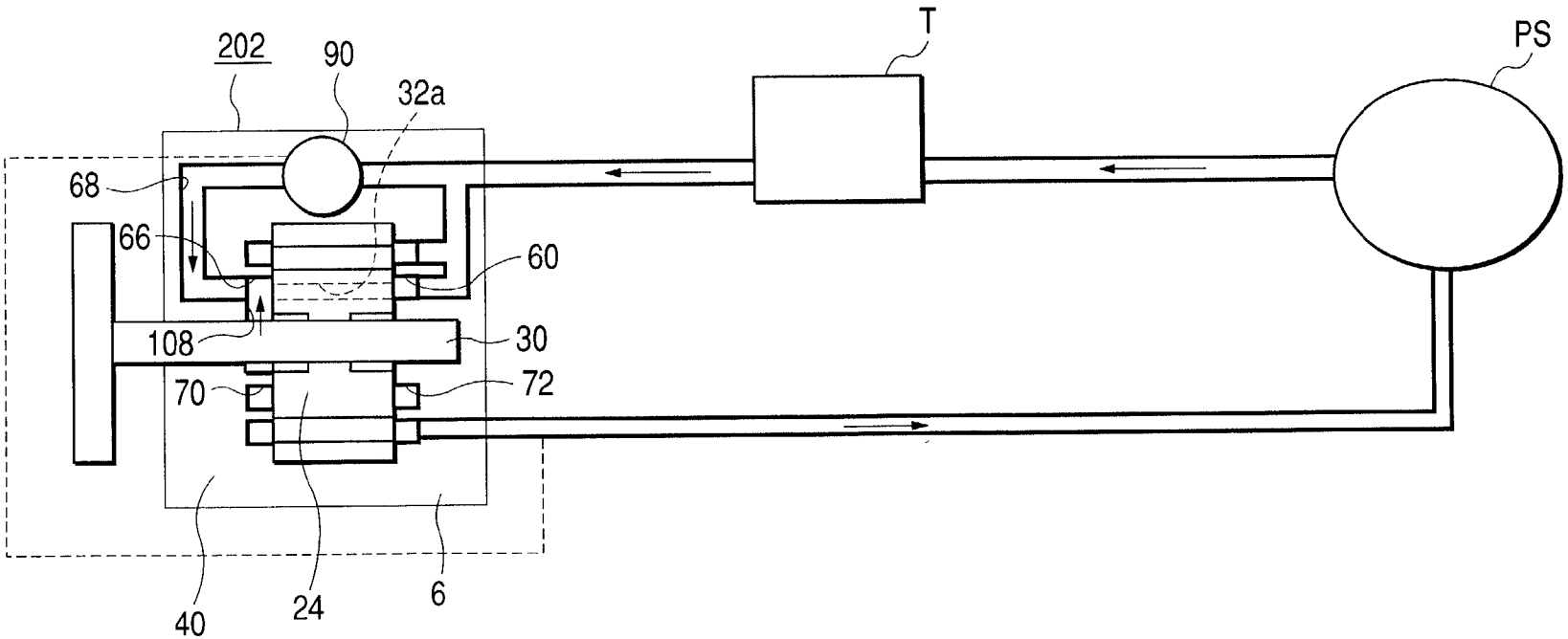
FIG. 8 is a simplified diagram showing a hydraulic circuit containing a variable displacement pump according to a third embodiment of the invention.

Referring to FIGS. 6 and 8, a variable displacement pump 102 according to a second embodiment of the invention will be described below. Since the fundamental constitution of the variable displacement pump 102 is the same as in the first embodiment, the same parts are designated by the same numerals, and not described here. In this embodiment, a restrictor 104 is provided halfway on the suction passage 46 from the tank T to the pump suction chamber. A connection passage 106 is formed to connect an upstream side of the restrictor 104 to the circular groove 60 in the suction area A formed on the face of the rear body 6 on the side of the rotor 24.

Figure 7:
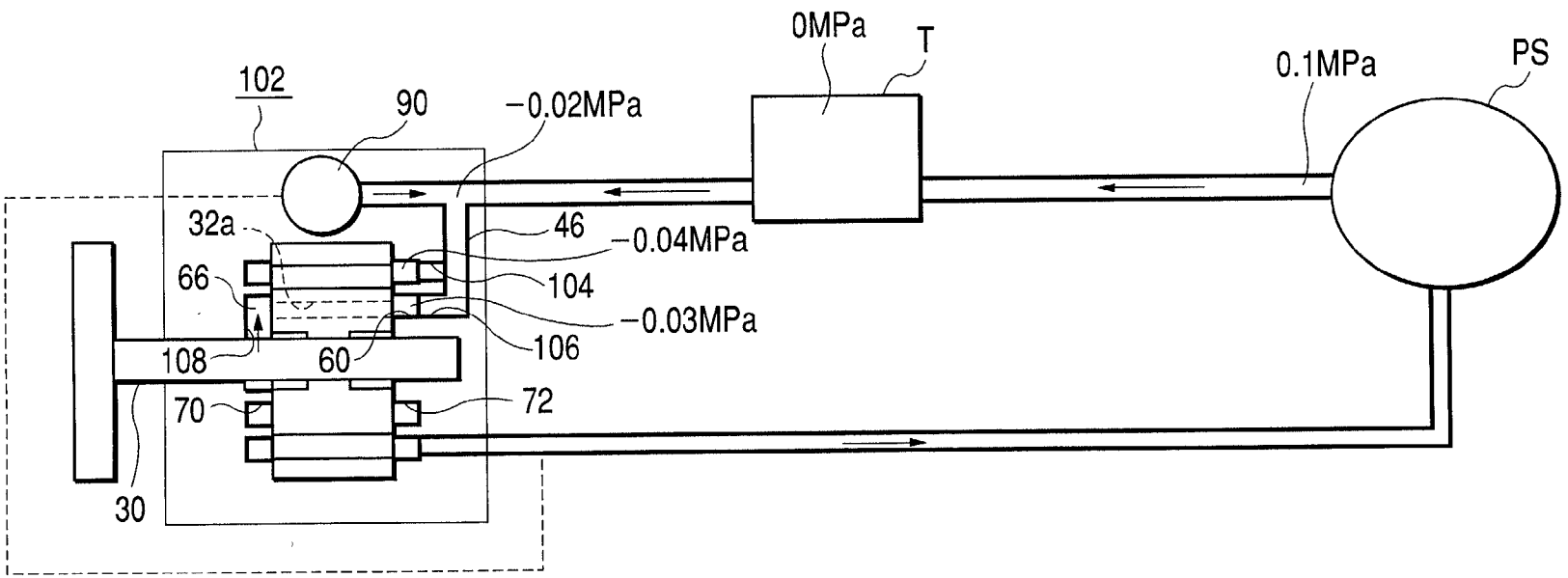
FIG. 7 is a simplified diagram showing a hydraulic circuit containing the variable displacement pump according to the second embodiment of the invention.

Also, if there is a great differential pressure of the restrictor 104 provided on the suction passage 46, the cavitation occurs. Hence, the great differential pressure can not be provided. Therefore, in some cases, an adequate pressure may not be introduced into the back pressure inlet bore 32*a* on the bottom of the slit 32. As auxiliary for such cases, an inlet passage 108 is provided for introducing an oil leaked from the circular grooves 70 and 72 in the discharge area B via clearance of the side of the rotor 24 to the outer circumference of the drive shaft 30, into the back pressure inlet bore 32*a* on the bottom of the slit 32. Though a working oil leaked from a side clearance of the rotor 24 around the drive shaft 30 is collected through an clearance of the bush (bearing) 26 and a return passage 110 to the pump suction side in the normal constitution, the pressure of working oil is higher than the pressure at the top end of the vane 34 (pump suction pressure) due to the small clearance of the bush 26 (by 0.01 MPa=−0.03 MPa−(−0.04 MPa) (FIG. 7)), and thus can effectively act to push out the vane 34.

In an illustrated example, the inlet passage 108 is provided for introducing the working oil leaked around the drive shaft 30 into the circular groove 66 in the suction area A formed on the pressure plate 40. However, a passage to the circular groove 60 in the suction passage A provided on the rear body 6 may be provided. An inlet passage for introducing oil leaked into the circular grooves 60 and 66 for the rear body 6 and the pressure plate 40 may be provided. A passage similar to the relief passage 68, which is provided in the variable displacement pump 2 according to the first embodiment, for introducing the working oil relieved from the relief valve 90 into the circular groove 66 formed in the suction area A of the pressure plate 40 may be formed. In this embodiment, the vane 34 is surely pushed out and pressed against the inner face of the cam ring 16 due to a pressure difference between the upstream side and the downstream side of the restrictor 104. Furthermore, the upstream pressure of the restrictor 104 is significantly lower than the pump discharge pressure in the related art, whereby it is possible to achieve the same effect of the first embodiment. If a required differential pressure can not be obtained, the working oil leaked from the discharge side is introduced via the inlet passage 108 into the circular groove 66 to push out the vane 34.

FIG. 8 shows a third embodiment, which is applicable to a large variable displacement pump 202. In the case of the large pump, the vane 34 is so large that a centrifugal force caused by rotation is great. Hence, in place of the restrictor 104 of the second embodiment, the centrifugal force can be used. The inlet passage 108 for introducing the oil leaked from the circular groove 70 and 72 in the discharge area B through the clearance of the side of the rotor 24 around the drive shaft 30 into the back pressure inlet bore 32*a* on the bottom of the slit 32 is provided. Whereby, the vane 34 is surely pushed out and pressed against the inner circumferential cam face of the cam ring 16, exhibiting the same effect of the above embodiments. In addition, the passage similar to the relief passage 68 for introducing the working oil relieved from the relief valve 90 into the circular groove 66 formed in the suction area A of the pressure plate 40 is formed.

Figure 9:
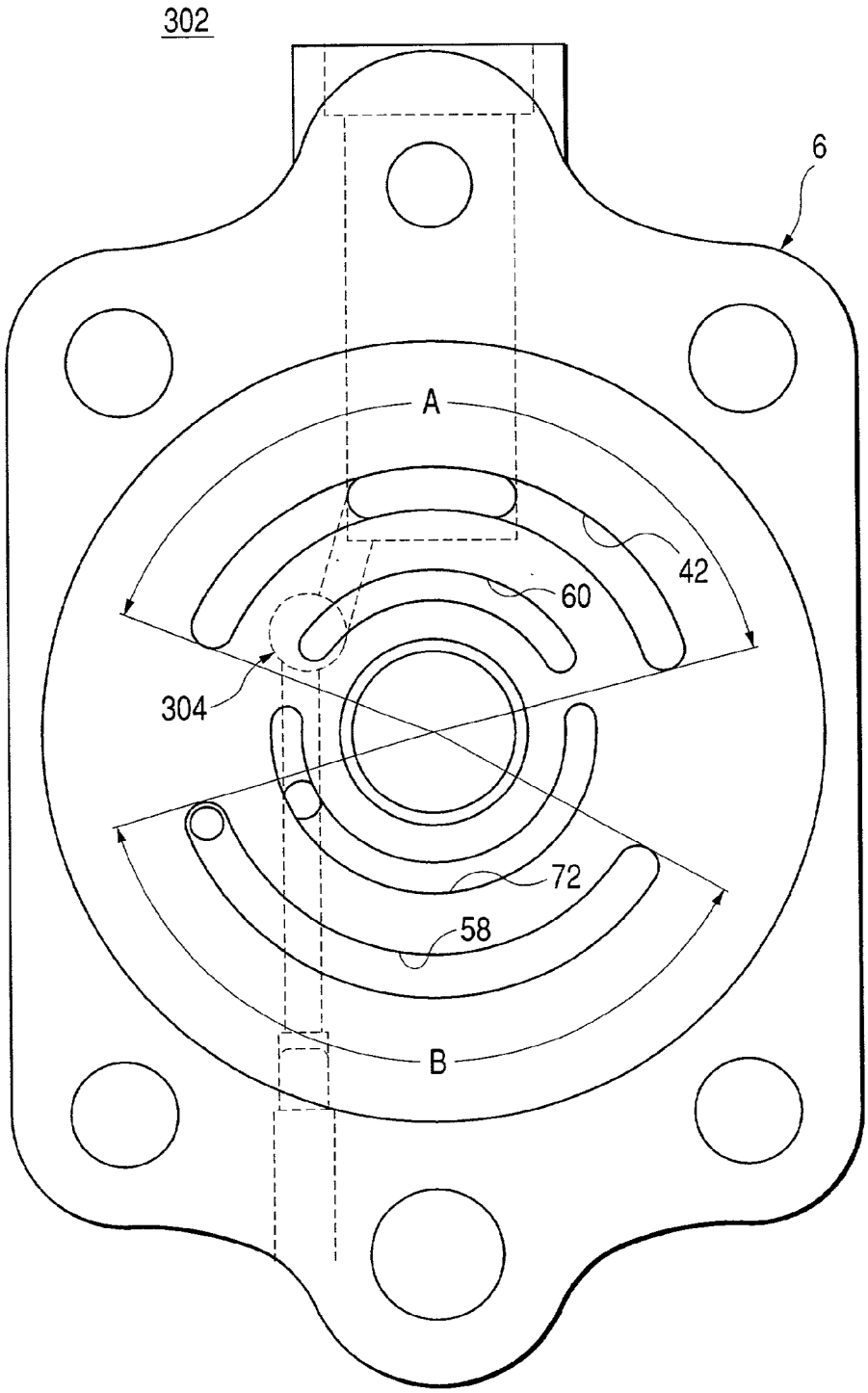
FIG. 9 is a front view of a rear body of a variable displacement pump according to a fourth embodiment of the invention.
Figure 10:
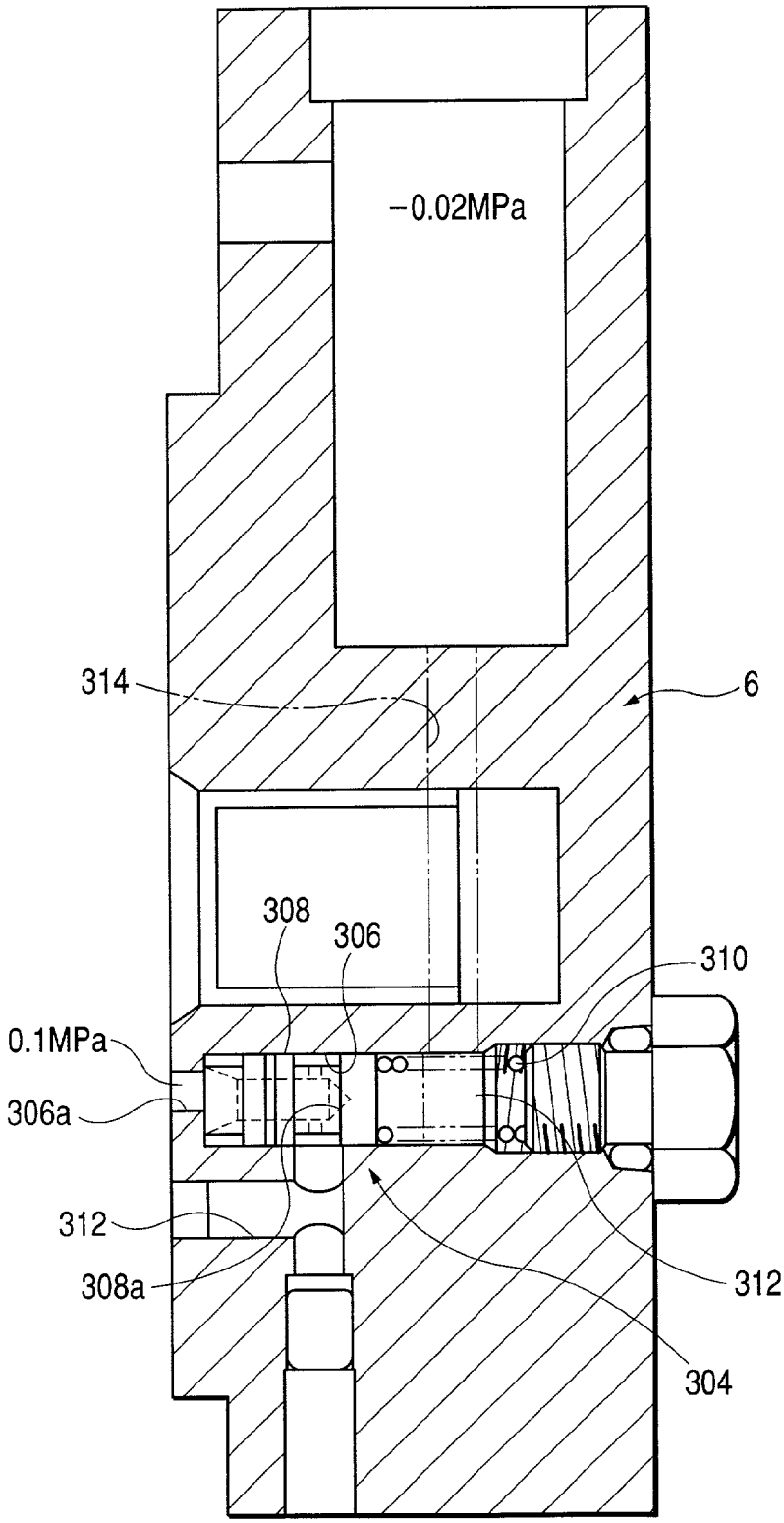
FIG. 10 is a longitudinal cross-sectional view of the rear body of the variable displacement pump.

FIGS. 9 and 10 are a front view and a longitudinal cross-sectional view of the rear body 6 for a variable displacement pump 302 according to a fourth embodiment of the invention. These figures correspond to FIGS. 4 and 5 in the first embodiment. Accordingly, the same parts are designated by the same numerals as in the first embodiment and not described here. Different parts will bee only described below. In this embodiment, a back pressure control valve 304, which is built in the rear body 6, controls the pressure on the pump discharge side (0.1 MPa) to be slightly higher than the suction pressure and introduces the controlled pressure into the circular groove 60 formed in the suction area A of the rear body 6.

The back pressure control valve 304 has a valve plug 308 fitted slidably within a valve bore 306 formed in the rear body 6, and urged by a spring 310 toward the rotor 24 (to the left in FIG. 10). An opening 306*a* of the valve bore 306 on the side of the rotor 24 is in communication to the circular groove 60 in the suction area A, and a passage 308*a* formed inside the valve plug 308 connects the opening 306*a* to a passage 312 on the discharge side (this passage communicates to the circular groove 72 or the discharge opening 58 in the discharge area B). The chamber 312 for receiving the spring 310 within the valve bore 306 communicates via the passage 314 to the pump suction side.

In this constitution, when the pump discharge pressure is increased to about 0.5 Mpa, the valve plug 308 compresses the spring 310, moves to the right in FIG. 10, and cutting off the communication between the circular groove 60 in the suction area A and the discharge side (circular groove 72 on the discharge side or the discharge opening 58) to prevent pressure of the circular groove 60 in the suction area A from further increasing. In this embodiment, the drive power for the pump can be reduced by providing lower friction loss between the inner circumferential cam face of the cam ring and the vane.

Figure 11:
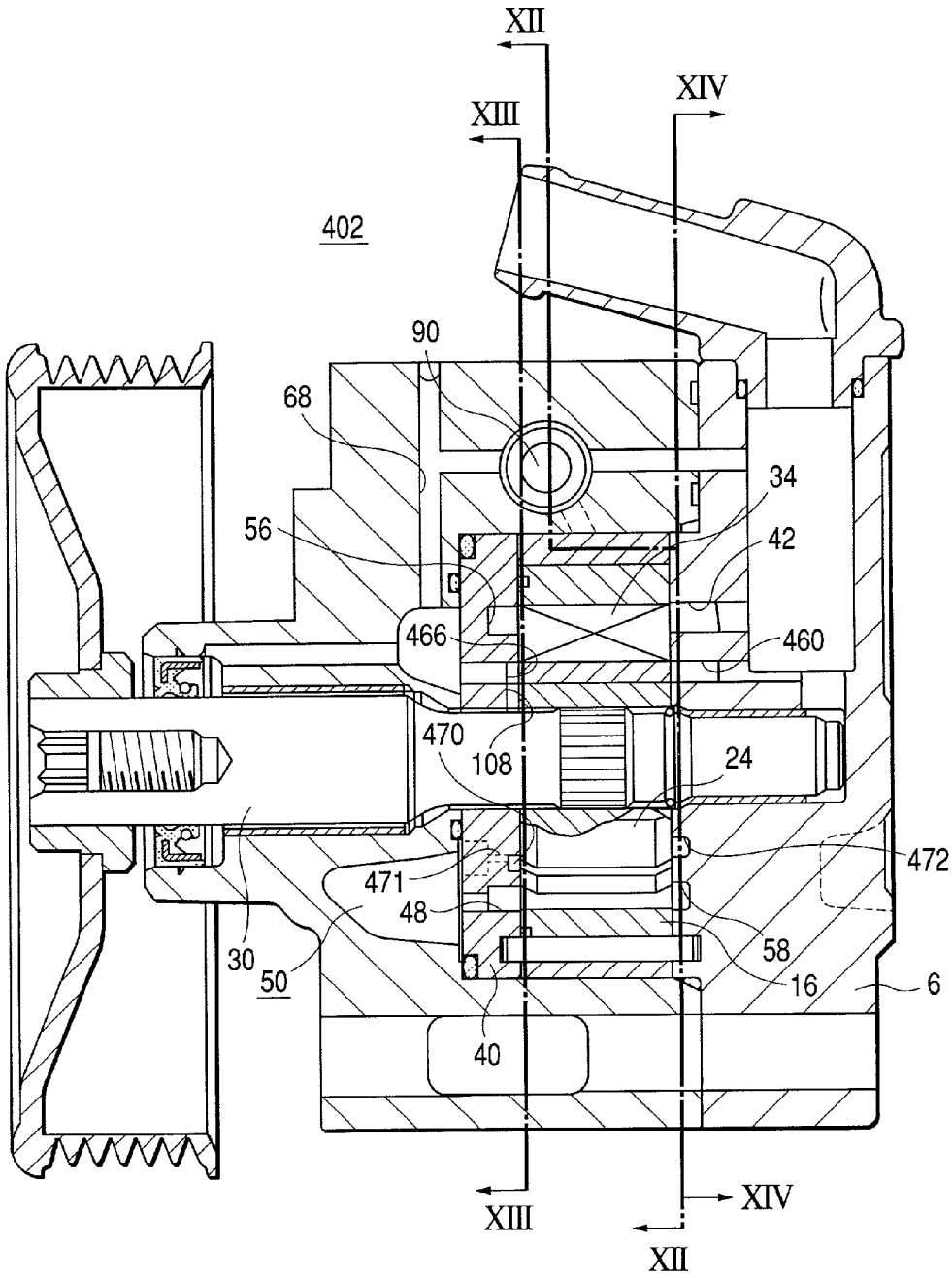
FIG. 11 is a cross-sectional view of a variable displacement pump according to a fifth embodiment of the invention, taken along the axial line of a drive shaft.
Figure 12:
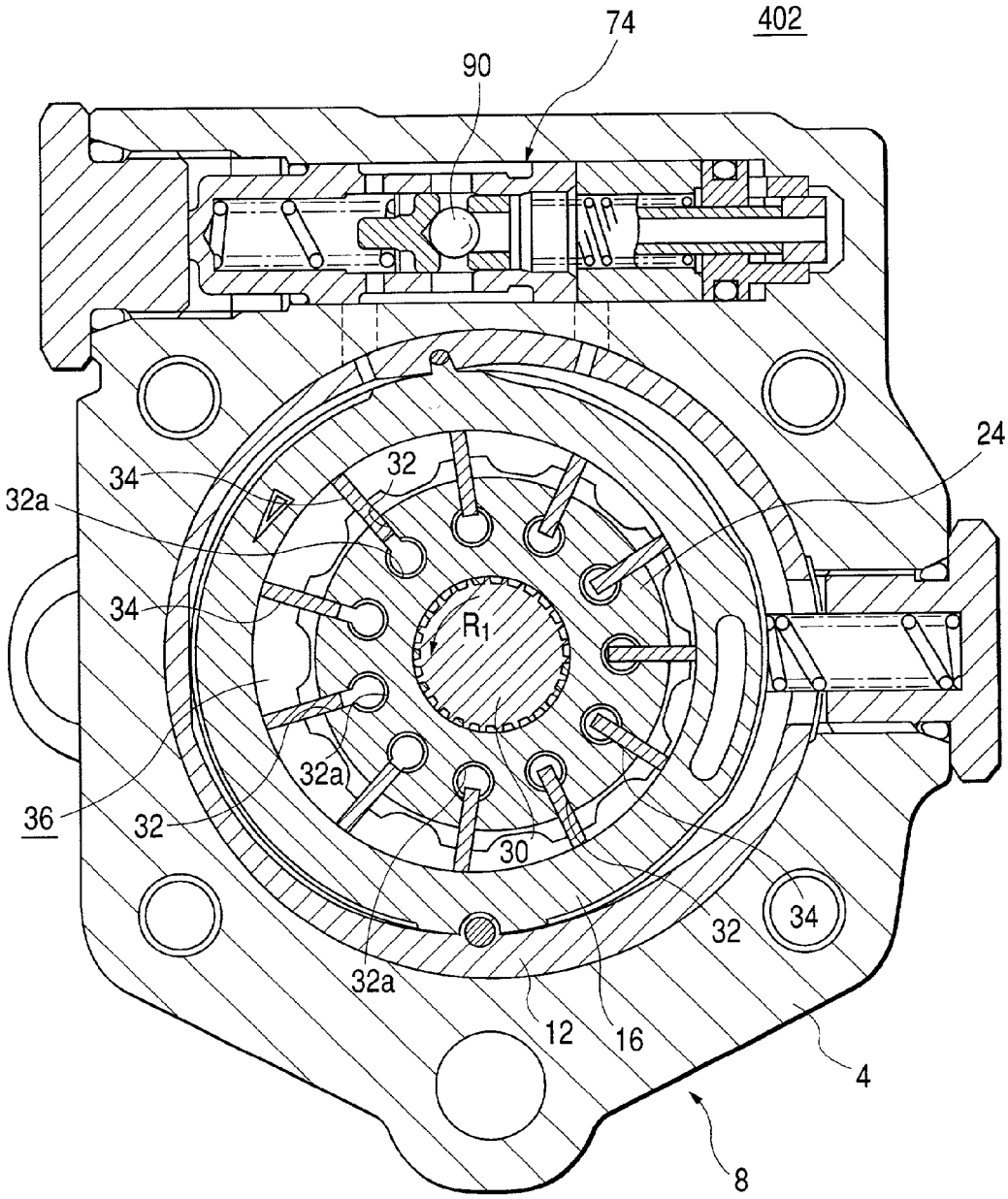
FIG. 12 is a cross-sectional view taken along the line XII—XII in FIG. 11.
Figure 13:
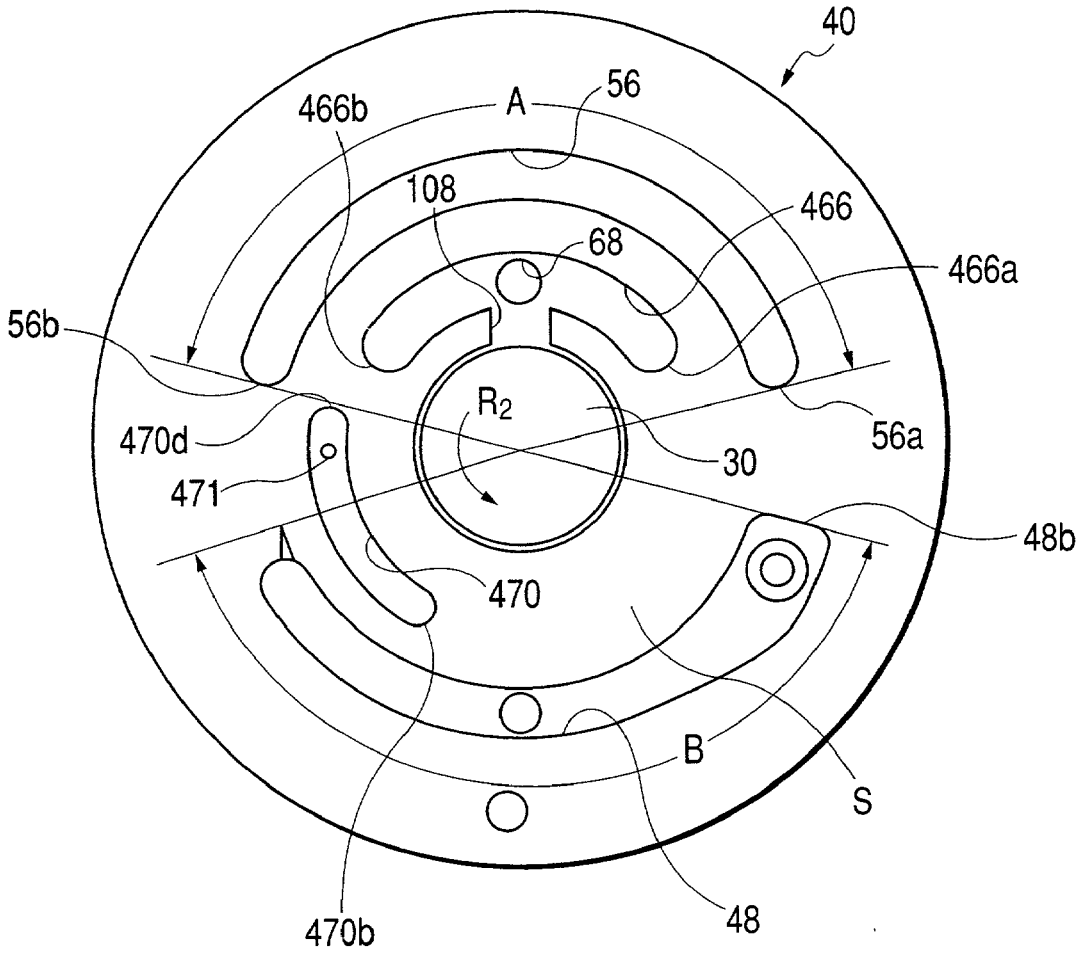
FIG. 13 is a cross-sectional view taken along the line XIII—XIII in FIG. 11.
Figure 14:
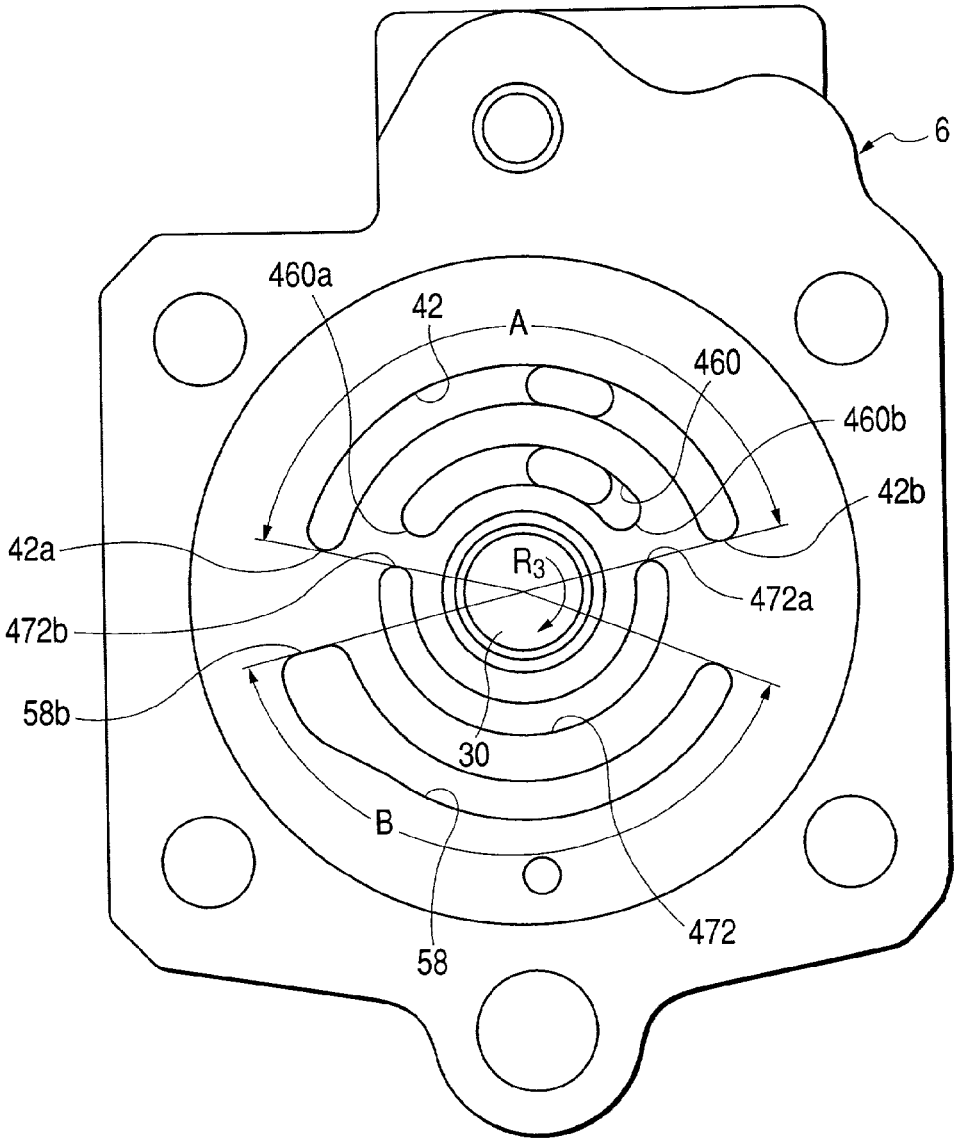
FIG. 14 is a cross-sectional view taken along the line XIV—XIV in FIG. 11.

FIGS. 11 to 14 are views of a variable displacement pump 402 according to a fifth embodiment of the invention. FIG. 11 is a view corresponding to FIG. 2 in the first embodiment. FIG. 12 is a cross-sectional view taken along the line XII—XII in FIG. 11, and corresponding to FIG. 1 in the first embodiment. FIG. 13 is across-sectional view taken along the line XIII—XIII in FIG. 11. FIG. 14 is a cross-sectional view taken along the line XIV—XIV in FIG. 11. A fundamental constitution of this variable displacement pump 402 is common to that of the first embodiment, and the same or like parts are designated by the same numerals as in the first embodiment, and not described here. In FIG. 13, the drive shaft 30 is rotated counterclockwise as indicated by an arrow $R_2$. In FIG. 14, the drive shaft 30 is rotated clockwise as indicated by an arrow $R_3$.

In this embodiment, the vane 34 is slidably inserted into each slit 32 formed radially on the outer circumferential portion of the rotor 24. An end portion of each slit 32 on the inner side is expanded to form a back pressure inlet bore 32*a*, in which the vane 34 is pushed out due to a hydraulic pressure introduced via a circular groove into the back pressure inlet bore 32*a*, and pressed against the inner circumferential cam face of the cam ring 16.

In the first embodiment, the circular grooves 60 and 66 in the suction area A formed in the pressure plate 40 and the rear body 6 disposed on both sides of the rotor 24 and the cam ring 16 have the same shape. The circular grooves 70 and 72 in the discharge area B also have the same shape. However, in this embodiment, of the circular grooves for introducing oil pressure into the back pressure inlet bore 32*a*, the circular grooves 460 and 466 formed in the suction area A have the same shape in the pressure plate 40 and the rear body (other plate) 6, while the circular grooves 470 and 472 formed in the discharge area B have different shapes in the pressure plate 40 and the rear body 6.

The circular grooves 466 and 460 formed in the suction area A of the pressure plate 40 and the rear body 6 has a length contained within the suction area A. On the other hand, the circular groove 472 formed in the discharge area B of the rear body 6 has its start point 472*a* located close to the end point 460*b* of the circular groove 460 in the suction area A, namely, near the end portion 42*b* of the suction opening 42 provided in the suction area A, and its end point 472*b* extended near the start point 460*a* of the circular groove 460 in the suction area A, namely, near the start portion 42*a* of the suction opening 42.

Also, the circular groove 470 formed in the discharge area B of the pressure plate 40, like the circular groove 472 in the discharge area B of the rear body 6, has its start point 470*a* located close to the end point 466*b* of the circular groove 466 in the suction area A, namely, near the end portion 56*b* of the suction opening 56, and its end point 470*b* located upstream of the discharge area B. Its leading portion (portion as denoted by sign S in FIG. 14) is flat to the start point 466*a* of the circular groove 466 in the suction area A.

Moreover, a passage hole 471 for connecting the circular groove 470 in the discharge area B formed in the pressure plate 40 to the discharge pressure chamber 50 is reduced in diameter to provide a restrictor passage. This restrictor passage 471 restricts a flow of oil passing from the circular groove 470 in the discharge area B to the discharge pressure chamber 50 to increase the pressure within the circular groove 470 in the discharge area B to help the vane 34 to jut out.

In this embodiment, if the drive shaft 30 and the rotor 24 start rotating at the start time, the vane 34 fitted into the slit 32 of the rotor 24 is slightly jutted out due to a centrifugal force and rotated. The cam ring 16 is eccentric to the rotor 24, and the distance between the outer face of the rotor 24 and the inner face of the cam ring 16 is the maximum in a transit portion from the suction area A to the discharge area B (see the left portion of FIG. 12). Since the vane is only jutted out due to centrifugal force, the top end of the vane 34 is not contacted with and left away from the inner face of the cam ring 16.

While the vane is moving in the discharge area B, the distance between the top end of the vane 34 and the inner face of the cam ring 16 is gradually smaller, and the top end of the vane 34 is barely contacted with the inner face of the cam ring 16 near the portion where the discharge area B is ended (end portion 48*b*, 58*b* of the discharge opening 48, 58), so that the vane 34 is pushed into the inside of the slit 21 by the cam ring 16. If the vane 34 is pushed into the inside of the slit 32, an oil between the base end portion of the vane 34 and the bottom portion of the slit 32 is pushed into the circular groove 472 in the discharge area B.

Near the portion where the discharge area B is ended, the vane 34 has already passed the endpoint 470*b* of the circular groove 470 formed in the discharge area B of the pressure plate 40, and the oil pushed out from the bottom of the slit 32 (through the back pressure inlet bore 32*a*) is flowed into the circular groove 472 in the discharge area B formed in the rear body 6. However, since the circular groove 472 of the rear body 6 has no passage communicating to the discharge pressure chamber 50, the oil flowed into the circular groove 472 flows back to the start point 472*a* of the circular groove 472. If reaching a portion of the pressure plate 40 where the circular groove 470 in the discharge area B is formed, the oil passes through the bottom portion (back pressure inlet bore 32*a*) of the slit 32 located in this portion into the circular groove 472 of the pressure plate 40.

The passage hole 471 communicating circular groove 470 formed in the discharge area B of the pressure plate 40 to the discharge pressure chamber 50 is a restricted passage with restricted diameter. Therefore, when the pressure in the circular groove 470 increases and the vane 34 inside the slit 32 is not jutted out to the position where it is contact with the cam ring 16, the oil flowed into the circular groove 470 in the discharge area B of the pressure plate 40 pushes the vane 34 out and presses the vane 34 against the cam ring 16 to start the variable displacement pump.

A variable displacement pump according to the fifth embodiment of the invention has the circular grooves 470 and 472 shaped as shown in FIGS. 13 and 14. The communicating passage 471 between the circular groove 470 in the discharge area B of the pressure plate 40 and the discharge pressure chamber 50 is formed into the restricted passage. Therefore, the start number of rotations for the variable displacement pump can be greatly reduced. Furthermore, in addition to this constitution, the relief passage 68 for introducing the oil relieved from the relief valve 90 and the inlet passage 108 for introducing the oil leaked from the circular grooves 470 and 472 in the discharge area B via an clearance on the side face of the rotor 24 around the outer circumference of the drive shaft 30 are provided. Therefore, the vane 34 can be pressed against the inner circumferential cam face of the cam ring 16 with an adequate force, while the variable displacement pump is operating, as with other embodiments.

Instead of the relief passage 68 and the inlet passage 108 for the leaked oil in the fifth embodiment, the communicating passage 64 for communicating the fluid passage 62 between the power steering gear PS and the tank T to the circular groove 60 in the suction area A may be provided, as with the first embodiment. As with the second embodiment, the connection passage 106 for connecting the upstream side of the restrictor 104 provided halfway on the suction passage between the tank T and the pump suction chamber to the circular groove 60 in the suction area A may be formed. Furthermore, the back pressure control valve 304 as described in the fourth embodiment may be provided inside the rear body 6.

As described above, according to the first aspect of the invention, the circular groove communicating to the bottom portion of the slits into which the vanes are retractably inserted is partitioned into the suction area groove and the discharge area groove, and a slightly higher pressure than on the pump suction side is introduced into the suction area groove, so that the pressure acting on the base end portion of the vane is slightly higher than the pump suction pressure, whereby the vane can be surely pushed out of the slit of the rotor and pressed against the inner face of the cam ring. Also, the pressure acting on the base end portion of the vane is slightly higher than the pump suction pressure, but is significantly lower than the conventional pump discharge pressure, so that the friction loss between the cam of the inner face of the cam ring and the vane is lower, and the drive power for the pump can be reduced. In the present invention, preferably, difference between the pressure acting on the base end portion of the vane and the pump suction pressure is in a range of 0.01 MPa to 0.1 MPa.

According to the second aspect of the invention, a circular groove communicating to the bottom portion of the slits into which the vanes are retractably inserted is partitioned into a suction area groove and a discharge area groove, in which the discharge area groove is formed in a range from a start point closer to an end portion of the suction area to a terminal point located halfway in the discharge area in one pressure plate of the both plates, and is formed in a range from a start point closer to an end portion of the suction area to a terminal point closer to a start portion in the suction area in the other plate, and the discharge area groove of the pressure plate and the discharge chamber are communicated via a restrictor passage. Hence, the vane is pushed out of the slit and pressed against the cam ring rapidly to start discharging at the start time when the discharge of oil from the pump is not started, whereby the variable displacement pump can be started at low number of rotations.

Moreover, according to the third aspect of the invention, a slightly higher pressure than on the pump suction side is introduced into the suction area groove. Thereby, the variable displacement pump can be started at low number of rotations, and the vane can be pushed out of the slit and surely pressed against the cam ring, while driving.

Also, according to the fourth aspect of the invention, the variable displacement pump of claim 1 is characterized in that the communication passage connecting to the suction area groove is formed in the passage between the fluid pressure utilization apparatus supplied with a pressure fluid discharged from the pump chamber formed between two adjacent vanes and the pump. Thereby, the vane can be surely pushed out and pressed against the cam ring, and the friction loss between the cam of the inner face of cam ring and the vane is lower, and the drive power for the pump can be reduced. Further, since the working fluid after use in the power steering gear is utilized, the discharge flow from the pump can be almost fully supplied to the power steering gear, without waste, and the drive power for the pump can be reduced.

Moreover, according to the fifth aspect of the invention, the variable displacement pump of claim 1 is characterized in that a restrictor is provided halfway on a suction passage from a tank to the pump chamber, and a connection passage for introducing an upstream pressure of the restrictor into the suction area groove is formed. Hence, the vane can be surely pushed out and pressed against the inner face of the cam ring, owing to a differential pressure between the upstream side and the downstream side of the restrictor. Further, the upstream pressure of the restrictor is significantly lower than the conventional pump discharge pressure, whereby there is the same effect as in the above inventions.

What is claimed is:

1. A viable displacement pump comprising:

a cam ring accommodated within a pump body;

a rotor rotating within the cam ring and formed slits at regular intervals circumferentially;

a plurality of vanes inserted retractably into the slits;

two plates carrying the cam ring and the rotor on both sides of the cam ring and the rotor; and wherein a circular groove communicating to bottom portions of the slits is partitioned into a suction area groove and discharge grooves;

wherein the discharge grooves are formed on a face of each of the both plates;

wherein the discharge grooves are not connected to the suction area groove;

wherein a pressure fluid is introduced into the circular groove to push out the vanes;

wherein a pump suction portion is formed on at least one of the plates; and wherein pressure introduced into the suction area groove is higher than pressure at the pump suction port and at least pressure at the suction port is introduced into the suction area groove.

2. The variable displacement pump according to claim 1, wherein a pump chamber is formed between two adjacent vanes;

wherein a restrictor is provided in the middle of a suction passage from a tank to the pump chamber; and wherein a connection passage for introducing an upstream pressure of the restrictor into the suction area groove is formed.

3. The variable displacement pump according to claim 2, wherein an inlet passage is formed for introducing a fluid, leaked from a discharge area on a periphery of a shaft driving the rotor, into the suction area groove.

4. The variable displacement pump according to claim 1, further comprising a relief valve built in the variable displacement pump, wherein a relief passage for supplying a fluid relieved from the relief valve to the suction area groove is formed; and wherein an inlet passage for introducing a fluid leaked from a discharge area to periphery of a shaft driving the rotor into the suction area groove is formed.

5. The variable displacement pump according to claim 1, wherein the pressure fluid introduced into the suction groove area is less than or equal to 0.07 MPa higher than the pressure at the pump suction port.

6. The variable displacement pump according to claim 1, wherein at least a portion of a pressure fluid introduced into the pump suction and at least a portion of the pressure fluid introduced into the suction groove have both exited a power steering gear.

7. The variable displacement pump according to claim 1, wherein a difference between pressure introduced into the suction area groove and pressure at the pump suction port is smaller than pressure at a pump discharge port.

8. The variable displacement pump according to claim 1, wherein pressure introduced into the discharge area groove is higher than that introduced into the suction area groove.

* * * * *